US006968896B2

(12) United States Patent
Coon

(10) Patent No.: US 6,968,896 B2
(45) **Date of Patent: *Nov. 29, 2005**

(54) ORIENTING WHIPSTOCK SEAT, AND METHOD FOR SEATING A WHIPSTOCK

(75) Inventor: Robert Joe Coon, Missouri City, TX (US)

(73) Assignee: Weatherford/Lamb, Inc., Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/458,979

(22) Filed: Jun. 11, 2003

(65) Prior Publication Data

US 2003/0196819 A1 Oct. 23, 2003

Related U.S. Application Data

(63) Continuation of application No. 09/938,168, filed on Aug. 23, 2001, now Pat. No. 6,591,905.

(51) Int. Cl.[7] ..... E21B 7/08; E21B 43/10

(52) U.S. Cl. ..... 166/117.6; 166/117.5; 166/207; 166/206; 166/50

(58) Field of Search ..... 166/207, 206, 166/208, 50, 313, 117.6, 117.5, 382, 255.3, 166/255.2; 175/81

(56) References Cited

U.S. PATENT DOCUMENTS

| | | | | |
|---|---|---|---|---|
| 761,518 | A | | 5/1904 | Lykken |
| 1,324,303 | A | | 12/1919 | Carmichael |
| 1,545,039 | A | | 7/1925 | Deavers |
| 1,561,418 | A | | 11/1925 | Duda |
| 1,569,729 | A | | 1/1926 | Duda |
| 1,597,212 | A | | 8/1926 | Spengler |
| 1,930,825 | A | | 10/1933 | Raymond |
| 1,981,525 | A | | 11/1934 | Price |
| 2,214,226 | A | | 9/1940 | English |
| 2,216,226 | A | | 10/1940 | Bumpous |
| 2,383,214 | A | | 8/1945 | Prout |
| 2,499,630 | A | | 3/1950 | Clark |
| 2,627,891 | A | | 2/1953 | Clark |
| 2,663,073 | A | | 12/1953 | Bieber et al. |
| 2,898,971 | A | | 9/1959 | Hempel |
| 3,087,546 | A | | 4/1963 | Wooley |
| 3,191,677 | A | | 6/1965 | Kinley |
| 3,195,646 | A | | 7/1965 | Brown |
| 3,467,180 | A | | 9/1969 | Pensotti |
| 3,474,651 | A | * | 10/1969 | Hicks et al. ..... 72/118 |
| 3,712,376 | A | | 1/1973 | Owen et al. |

(Continued)

FOREIGN PATENT DOCUMENTS

| | | |
|---|---|---|
| EP | 0 961 007 | 12/1999 |

(Continued)

*Primary Examiner*—David Bagnell
*Assistant Examiner*—G M Collins
(74) *Attorney, Agent, or Firm*—Patterson & Sheridan LLP

(57) ABSTRACT

The present invention provides an apparatus and methods for seating a whipstock. The apparatus comprises an expandable seat, or nipple, configured to receive a whipstock. The seat is run into a cased wellbore, and is set by expanding it into frictional contact with the inner surface of the casing. Thereafter, a whipstock is seated onto the seat. The seat includes a keyway configured to receive an orientation member extending from the whipstock. In this manner, the orientation of the seat can be determined. An orientation member of the whipstock can be adjusted to properly orient the face of the whipstock in the seat, and the whipstock lowered onto the seat so that it automatically seats in the proper direction. The whipstock then serves as a diverter tool for drilling a lateral wellbore such as a horizontal well.

2 Claims, 5 Drawing Sheets

U.S. PATENT DOCUMENTS

| | | | | |
|---|---|---|---|---|
| 3,776,307 | A | 12/1973 | Young | |
| 3,818,734 | A | 6/1974 | Bateman | |
| 3,911,707 | A | 10/1975 | Minakov et al. | |
| 3,948,321 | A | 4/1976 | Owen et al. | |
| 4,069,573 | A | 1/1978 | Rogers, Jr. et al. | |
| 4,127,168 | A | 11/1978 | Hanson et al. | |
| 4,159,564 | A | 7/1979 | Cooper, Jr. | |
| 4,288,082 | A | 9/1981 | Setterberg, Jr. | |
| 4,319,393 | A | 3/1982 | Pogonowski | |
| 4,324,407 | A | 4/1982 | Upham et al. | |
| 4,429,620 | A | 2/1984 | Burkhardt et al. | |
| 4,516,634 | A * | 5/1985 | Pitts | 166/120 |
| 4,531,581 | A | 7/1985 | Pringle et al. | |
| 4,588,030 | A | 5/1986 | Blizzard | |
| 4,697,640 | A | 10/1987 | Szarka | |
| 4,848,469 | A | 7/1989 | Baugh et al. | |
| 5,052,483 | A | 10/1991 | Hudson | |
| 5,271,472 | A | 12/1993 | Leturno | |
| 5,348,095 | A | 9/1994 | Worrall et al. | |
| 5,398,754 | A | 3/1995 | Dinhoble | |
| 5,409,059 | A | 4/1995 | McHardy | |
| 5,409,060 | A | 4/1995 | Carter | |
| 5,435,400 | A | 7/1995 | Smith | |
| 5,467,819 | A | 11/1995 | Braddick | |
| 5,472,057 | A | 12/1995 | Winfree | |
| 5,533,573 | A | 7/1996 | Jordan, Jr. et al. | |
| 5,560,426 | A | 10/1996 | Trahan et al. | |
| 5,685,369 | A | 11/1997 | Ellis et al. | |
| 5,901,787 | A | 5/1999 | Boyle | |
| 6,012,516 | A | 1/2000 | Brunet | |
| 6,021,850 | A | 2/2000 | Wood et al. | |
| 6,029,748 | A | 2/2000 | Forsyth et al. | |
| 6,070,671 | A | 6/2000 | Cumming et al. | |
| 6,098,717 | A | 8/2000 | Bailey et al. | |
| 6,138,761 | A | 10/2000 | Freeman et al. | |
| 6,186,233 | B1 | 2/2001 | Brunet | |
| 6,325,148 | B1 | 12/2001 | Trahan et al. | |
| 6,354,373 | B1 * | 3/2002 | Vercaemer et al. | 166/277 |
| 6,419,025 | B1 * | 7/2002 | Lohbeck et al. | 166/380 |
| 6,419,026 | B1 * | 7/2002 | MacKenzie et al. | 166/381 |
| 6,425,444 | B1 | 7/2002 | Metcalfe et al. | |
| 6,446,323 | B1 | 9/2002 | Metcalfe et al. | |
| 6,457,532 | B1 | 10/2002 | Simpson | |
| 6,527,049 | B2 | 3/2003 | Metcalfe et al. | |
| 6,543,552 | B1 | 4/2003 | Metcalfe et al. | |
| 6,571,871 | B2 | 6/2003 | Lauritzen | |
| 6,679,329 | B2 * | 1/2004 | Murray et al. | 166/313 |
| 2001/0040054 | A1 | 11/2001 | Haugen et al. | |
| 2001/0045284 | A1 | 11/2001 | Simpson | |
| 2002/0011340 | A1 * | 1/2002 | Murray | 166/380 |
| 2002/0079100 | A1 | 6/2002 | Simpson et al. | |
| 2002/0096326 | A1 | 7/2002 | Buytaert | |
| 2002/0139540 | A1 | 10/2002 | Lauritzen | |
| 2002/0145281 | A1 | 10/2002 | Metcalfe et al. | |
| 2002/0166668 | A1 | 11/2002 | Metcalfe et al. | |
| 2002/0174992 | A1 * | 11/2002 | Dewey et al. | 166/382 |
| 2003/0037931 | A1 | 2/2003 | Coon | |
| 2003/0047320 | A1 | 3/2003 | Badrak et al. | |

FOREIGN PATENT DOCUMENTS

| | | |
|---|---|---|
| GB | 887150 | 1/1962 |
| GB | 1 448 304 | 9/1976 |
| GB | 2 216 926 | 10/1989 |
| GB | 2 320 734 | 7/1998 |
| GB | 2 329 918 | 4/1999 |
| WO | WO 93/24728 | 12/1993 |
| WO | WO 99/18328 | 4/1999 |
| WO | WO 99/23354 | 5/1999 |
| WO | WO 00/37773 | 6/2000 |
| WO | WO 01/60545 | 8/2001 |

* cited by examiner

ORIENTING WHIPSTOCK SEAT, AND METHOD FOR SEATING A WHIPSTOCK

CROSS-REFERENCE TO RELATED APPLICATIONS

This application is a continuation of U.S. patent application Ser. No. 09/938,168, filed Aug. 23, 2001, now U.S. Pat. No. 6,591,905. The aforementioned related patent application is herein incorporated by reference.

BACKGROUND OF THE INVENTION

1. Field of the Invention

The present invention relates to a seating apparatus for a whipstock. More particularly the present invention relates to an expandable seat used to land a whipstock prior to the milling of a window through casing. The present invention also relates to a method for seating a whipstock in a parent wellbore.

2. Description of Related Art

In recent years, technology has been developed which allows an operator to drill a primary vertical well, and then later drill an angled lateral hole off of that vertical well at a chosen depth. The vertical wellbore, sometimes referred to as the parent wellbore, is cased with a string of casing and then cemented. In some cases, that parent wellbore is completed and hydrocarbons are produced from a downhole formation through that parent wellbore for a period of time before the lateral wellbore is created. In other cases, a lateral wellbore is completed along with or even in lieu of the parent wellbore.

In creating a lateral wellbore, an anchor, a slip mechanism, or an anchor-packer is typically set in the parent wellbore at a depth where deflection is desired. The anchoring device acts as a seat against which tools above it may be urged, including a whipstock. The whipstock is positioned in the casing above the anchoring device. Correct orientation of the whipstock is determined using a survey tool.

The whipstock is specially configured to divert milling bits and then a drill bit in a desired direction for forming a lateral wellbore. This process is sometimes referred to alternatively as sidetrack drilling, horizontal drilling, or directional drilling.

A stinger is typically located at the bottom of the whipstock which engages the anchor device or packer. In this respect, splined connections between the stinger and the anchor facilitate correct stinger orientation. The stinger allows the concave face of the whipstock to be properly oriented so as to direct the milling operation.

In some completions, it is desirable to seat the whipstock onto a tubular nipple in the casing string rather than using a packer. This avoids the necessity of running a separate anchoring device within the casing. Currently it is known to employ one or more seats, referred to as nipples, screwed into the casing string at the depth at which a lateral wellbore is to be drilled.

A substantial disadvantage exists with the use of currently-known casing nipples for seating a whipstock. The primary disadvantage is that, in drilling the parent wellbore, it is unknown precisely where a lateral wellbore will need to be deployed. Those of ordinary skill in the art will appreciate that downhole testing oftentimes is not conducted until after the parent wellbore is cased and cemented. Moreover, in many instances the drilling of a lateral wellbore does not take place until some extended period of time after the parent wellbore is completed. Therefore, some in the industry are incurring the time and expense of installing multiple casing seats within the casing string at various depths during the drilling operation. This increases the expense and complexity of the well completion process.

An additional disadvantage to the presetting of whipstock nipples within the casing string is that the orientation of each seat becomes fixed. In this respect, the orientation of the seats cannot be changed once they become part of the cemented casing string.

There exists, therefore, a need for a whipstock seat which can be set within casing at a time after the parent wellbore has been cased and cemented.

It is, therefore, one of the many objects of the present invention to provide a novel seat for landing a whipstock, wherein the seat can be set at a location in the casing of a parent wellbore after the casing has been cemented in place.

An additional object of the present invention is to provide a seat configured to receive a whipstock in such a manner that the whipstock is automatically oriented in a desired direction for directional drilling.

Yet an additional object of the present invention is to provide a seat for seating a whipstock which is expandable into the casing at a desired depth.

It is still an additional object to provide a method for seating a whipstock onto an expandable seat.

Additional objects and advantages will become apparent from the detailed description of the invention, below.

SUMMARY OF THE INVENTION

The present invention provides an apparatus for seating a whipstock, and a method for seating a whipstock within a cased wellbore.

The apparatus of the present invention comprises an expandable seat which is run into a cased wellbore at the lower end of a string of tubulars. The seat is releasably connected to an expander tool. At the appropriate depth, the expander tool is activated so as to expand a portion of the whipstock seat into contact with the casing. The connection between the expander tool and the seat is then released. The expander tool can then be reciprocated in a rotational and vertical fashion so as to expand the entire seat into a frictional connection with the cemented casing.

After the seat is expanded into position, the expander tool is removed from the wellbore. A whipstock is then run into the hole where it is landed onto the seat. The inner surface of the seat is dimensioned to receive the whipstock therein. Further, the inner surface is profiled so as to direct a key portion in the whipstock, thereby orienting the whipstock in the direction desired for drilling a lateral wellbore. In the preferred embodiment, a complete through-opening in the wall of the seat is formed to serve as the keyway.

The inner surface of the seat is optionally profiled for receiving dogs in the outer surface of the whipstock. This allows the whipstock to be seated more securely, and facilitates the removal of the run-in string without also pulling the whipstock. In this respect, a shearable or other releasable connection is employed between the run-in string and the whipstock so as to allow the whipstock to be released from the run-in string once the whipstock is seated. In one embodiment, the whipstock is releasably connected to a milling device so that milling of the casing may be commenced without incurring a trip out of the hole.

BRIEF DESCRIPTION OF THE DRAWINGS

So that the manner in which the above recited features, advantages and objects of the present invention are attained and can be understood in detail, a more particular description of the invention, briefly summarized above, may be had by reference to the embodiments thereof which are illustrated in the appended drawings.

It is to be noted, however, that the appended drawings illustrate only typical embodiments of this invention and are therefore not to be considered limiting of its scope, for the invention may admit to other equally effective embodiments.

DETAILED DESCRIPTION OF THE PREFERRED EMBODIMENT

Figure 1:
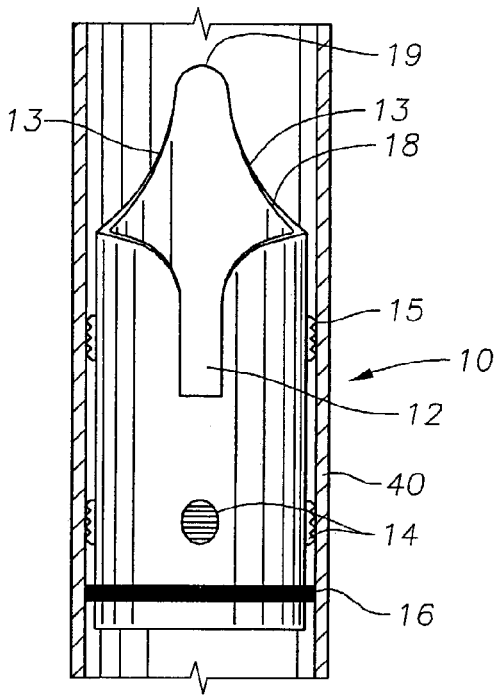
FIG. 1 is a schematic view of the front of the whipstock seat of the present invention, in contact with the inner surface of the casing of a parent wellbore.

FIG. 1 is a schematic view of a whipstock seat 10, or nipple, of the present invention. In this view, the front of the whipstock seat 10 is depicted. The seat 10 defines a tubular apparatus to be concentrically fitted within the casing 40 of a wellbore 44. This necessarily means that the outer diameter of the seat 10 is less than the inner diameter of the casing 40.

The seat 10 is designed to serve as a landing for a whipstock 30, or diversion tool. To accomplish this purpose, the inner diameter of the seat 10 is dimensioned to receive the whipstock 30. The seat is profiled to create a keyway 12 for receiving an orientation member 38 in the whipstock 30. In the preferred embodiment, the keyway 12 defines a through-opening through both the inner surface and outer surface of the seat 10. However, it is within the scope of this invention to provide a keyway which defines a profile within the inner surface of the seat only (not shown).

The seat 10 includes a top edge 18 which tapers downward from an upper point 19 towards the keyway 12. As will be disclosed, the tapered configuration allows the seat 10 to guide an orientation member 38 of a whipstock 30 into proper orientation.

Figure 2:
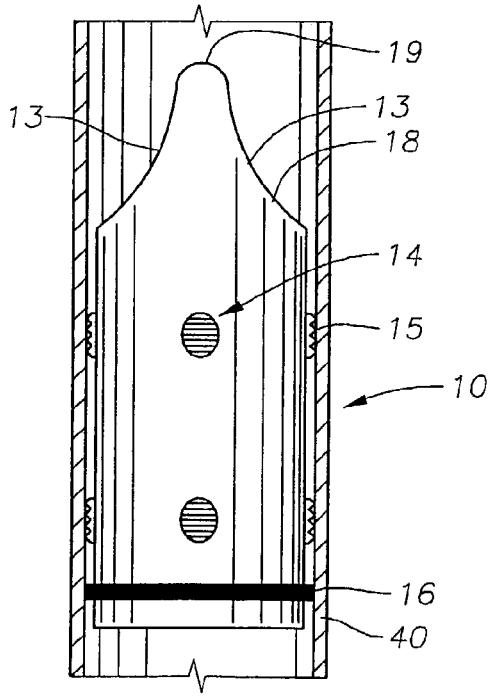
FIG. 2 is a schematic view of the rear of the whipstock seat of the present invention, in contact with the inner surface of the casing of a parent wellbore.

FIG. 2 is a schematic view of the rear of a whipstock seat 10 of the present invention. In both this view and in the view of FIG. 1, the seat 10 has been expanded so as to create a friction fit between the outer surface of the seat 10 and the inner surface of the casing 40. Thus, the seat 10 essentially defines an expandable body portion and a locating surface thereupon for directing another tool into a predetermined position within the apparatus 10.

The preferred embodiment of the seat apparatus 10 includes a plurality of slips 14 on the outer surface. In one aspect, the slips 14 define buttons having teeth 15 for gripping the inner surface of the casing 40, thereby providing further friction between the seat 10 and the casing 40 so as to facilitate the setting of the seat 10 within the casing 40. The slips 14 may be of any shape, and may even define a contiguous ring (not shown) around the outside surface of the seat 10. In one aspect, the teeth 15 of the slips 14 are fabricated from a carbide material. It is within the scope of this invention 10 to utilize slips of other forms and materials, such as an array of teeth (not shown) helically machined into the outer surface of the seat 10, or no slips at all.

Figure 3:
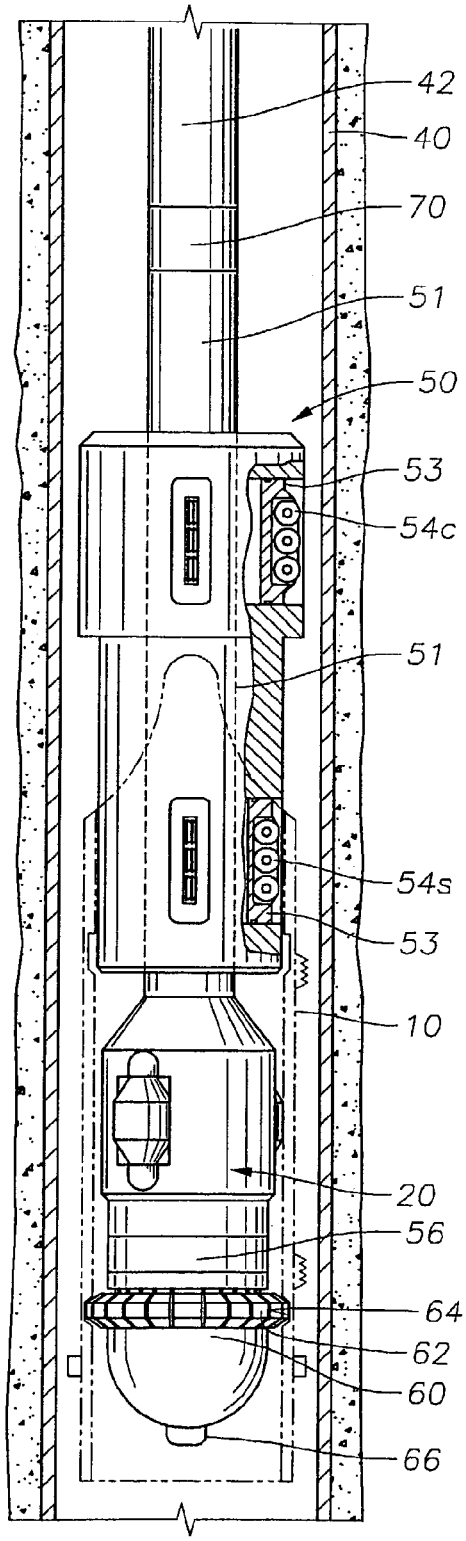
FIG. 3 is a perspective view of the expander tool connected to the whipstock seat of the present invention in a downhole position, with the seat shown in phantom. In addition, a torque anchor is shown to stabilize the seat while it is first being expanded. In this view, the expander tool has not yet been activated to expand the whipstock seat.

The seat 10 is lowered into the parent wellbore 44 on a tubular string 42 such as jointed tubing or coiled tubing. FIG. 3 presents a seat of the present invention 10 positioned at the lower end of a working tubular 42. In this figure, the seat 10 is presented in phantom.

FIG. 3 also presents an expander tool 20, to be used in expanding the seat 10. The expander tool 20 is more fully shown in FIG. 4, which is an exploded view of an exemplary expander tool 20. In this view, the expander tool 20 has not yet been activated to expand the whipstock seat 10.

Figure 4:
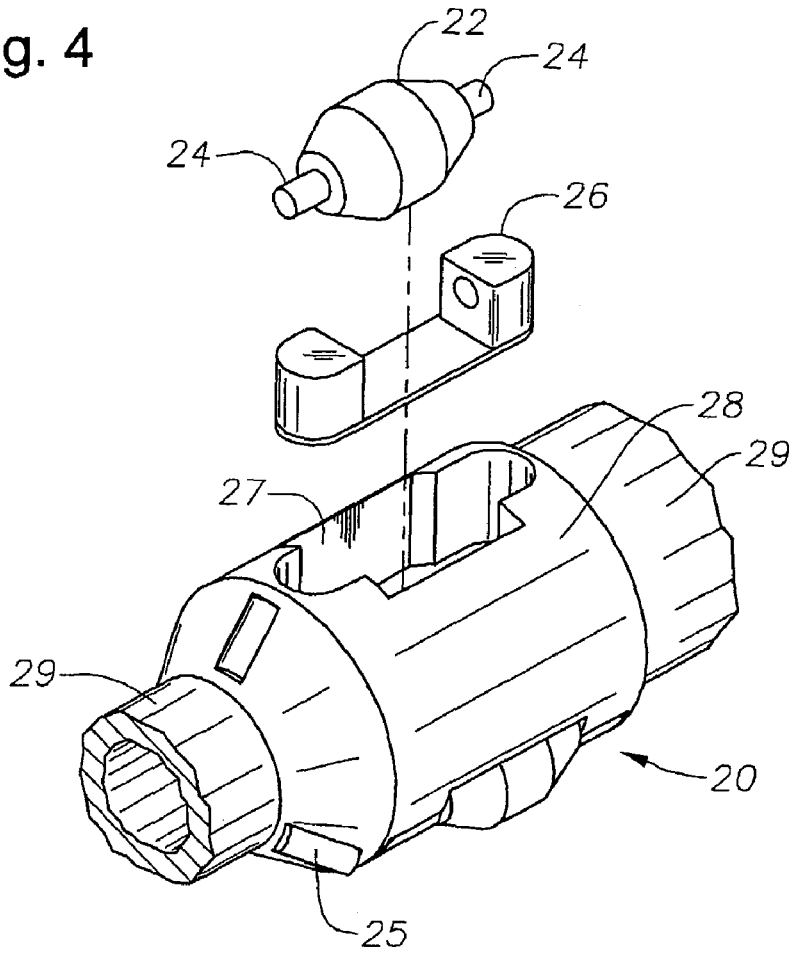
FIG. 4 is an exploded view of an expander tool.

In the embodiment shown in FIG. 4, the expander tool 20 has a body 28 which is hollow and generally tubular, and having connectors 29 for connection to other components (not shown) of a downhole assembly. The connectors 29 are of a reduced diameter compared to the outside diameter of the longitudinally central body part 28 of the tool 20. The central body part 28 has three recesses 27 to hold a respective roller 22. Each of the recesses 27 has parallel sides and extends radially from a radially perforated tubular core (not shown) of the tool 20. Each of the mutually identical rollers 22 is somewhat cylindrical and barreled. Each of the rollers 22 is mounted by means of an axle 24 at each end of the respective roller and the axles are mounted in slidable pistons 26. The rollers 22 are arranged for rotation about a respective rotational axis which is parallel to the longitudinal axis of the tool 20 and radially offset therefrom at 120-degree mutual circumferential separations around the central body 28. The axles 24 are formed as integral end members of the rollers and the pistons 26 are radially slidable, one piston 26 being slidably sealed within each radially extended recess 27. The inner end of each piston 26 is exposed to the pressure of fluid within the hollow core of the tool 20 by way of the tubular 42. In this manner, pressurized fluid provided from the surface of the well, via the tubular 42, can actuate the pistons 26 and causes them to extend outwardly whereby the rollers 22 contact the inner surface of the seat 10 to be expanded.

The tubular 42 optionally includes instrumentation, shown schematically at 70, for orienting the seat 10, or for determining the orientation of the seat 10. In this manner, the orientation of the seat 10 may be determined when the seat 10 is set into the casing 40.

Figure 5:
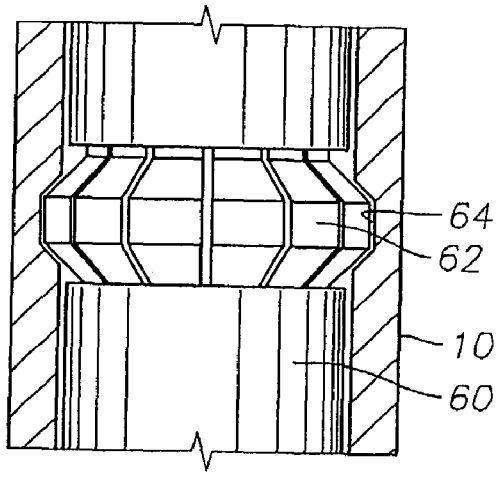
FIG. 5 is a perspective view of a collet landed in a collet profile for releasably connecting the expander tool to the seat.

In the perspective view of FIG. 3, the expander tool 20 has not yet been activated to expand the whipstock seat 10. The expander tool 20 is held to the whipstock seat 10 by at least one releasable connection 62. In one embodiment, the releasable connection is shearable, and defines a pin (not shown) connected to the whipstock seat 10, such as by welding. However, in the preferred embodiment, the connection is a collet 62 attached to a nipple 60 below the expander tool 20. The collet 62 is a segmented metal member which encircles the nipple 60, and resides in a collet profile 64 formed within the inner surface of the seat 10. This arrangement provides more secure support for the seat 10 on the expander tool 20 as it is run into the hole 44. A fuller view of the collet 62 landed in the collet profile 64 is shown in FIG. 5.

The nipple 60 shown in FIG. 3 includes a nozzle 66. The nozzle 66 serves as an outlet through which fluid may be circulated. The nozzle 66 defines a sized orifice by which pumped fluid can reach critical flow. Once critical flow is reached, pressure builds within the torque anchor 50 and the expander tool 20 for activation of extending parts 54*c*, 54*s* and 22.

At the appropriate depth, and while the collet 62 continues to support the seat 10, the expander tool 20 is activated so as to expand a portion of the whipstock seat 10 into contact with the casing 40. A swivel 56 allows the expander tool 20 to rotate while the collet 62 continues to engage and support the seat 10. The expander tool 20 is rotated so as to create complete radial contact between a portion of the whipstock seat 10 and the casing 40. In one aspect, expansion of a portion of the casing 40 at the initial depth of the expander tool 20 will cause the seat 10 to release the collet 62, such that the collet 62 is no longer affixed within the collet profile 64. The expander tool 20 can then be reciprocated in both a rotational and vertical fashion so as to expand the entire seat 10 into a frictional connection with the cemented casing 40.

It is within the scope of the invention to provide a collet 62 which is capable of being mechanically retracted from the collet profile 64. In this respect, the collet 62 would be released via mechanical switch or via release of pressure from a fluid line, or other means known in the art for releasing a collet 62. Thus, the collet 62 would be retracted from the collet profile 64 at the time an initial portion of the seat is expanded into contact with the inner surface of the casing 40.

At the appropriate depth, the expander tool 20 is activated so as to expand a portion of the whipstock seat 10 into contact with the casing 40. The expander tool 20 is then rotated so as to release the connection between the expander tool 20 and the seat 10. The expander tool 20 is also reciprocated in a rotational and vertical fashion so as to expand the entire seat 10 into a frictional connection with the cemented casing 40.

It is further within the scope of this invention to provide a shear pin (not shown) or other releasable connection between the expander tool 20 and the seat 10 in lieu of or in addition to a collet. Where a shearable pin is used, rotation of the expander tool 20 serves to release the connection between the expander tool 20 and the seat 10. The expander tool 20 is also reciprocated in a rotational and vertical fashion so as to expand the entire seat 10 into a frictional connection with the cemented casing 40.

As a further aid in the expansion of the whipstock seat 10, a torque anchor 50 may be utilized. The torque anchor 50 is designed to prevent the seat 10 from rotating while the expander tool 20 acts against the seat 10. The torque anchor 50 defines a body having sets of wheels 54*c* and 54*s* radially disposed around its perimeter. The wheels 54*c* and 54*s* reside within wheel housings 53, and are oriented to permit axial (vertical) movement, but not radial movement, of the torque anchor 50. Sharp edges (not shown) along the wheels 54*c* and 54*s* aid in inhibiting radial movement of the torque anchor 50. In the preferred embodiment, four sets of wheels 54*c* and 54*s* are employed to act against the casing 40 and the seat 10, respectively.

Figure 6:
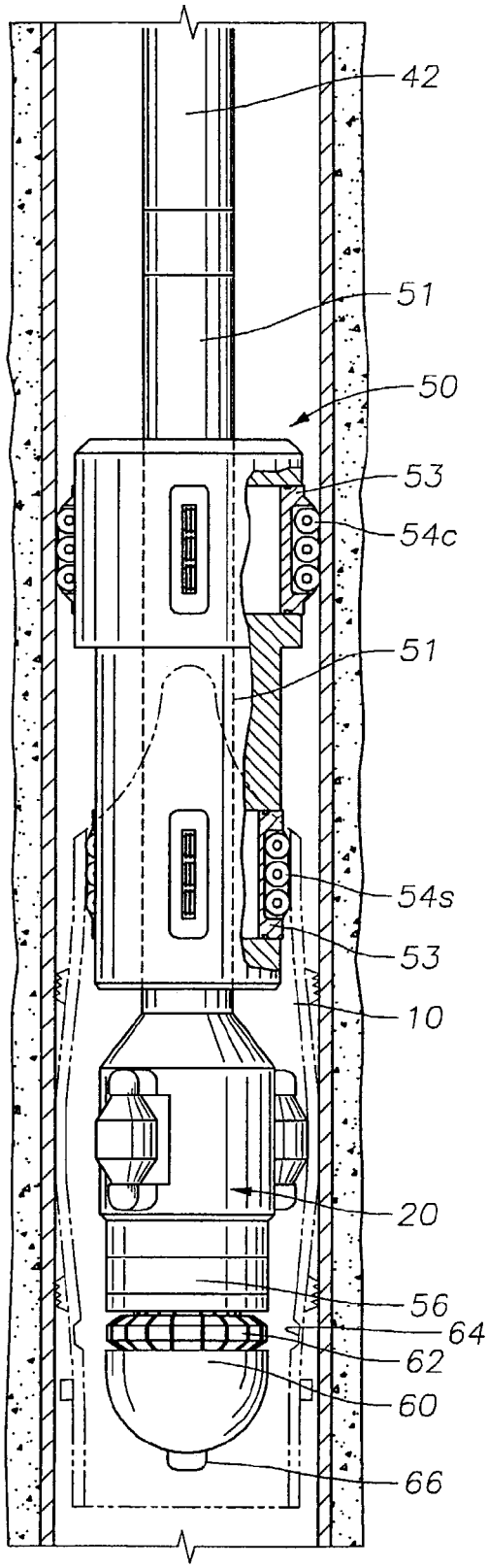
FIG. 6 is a side view of the expander tool and whipstock seat of FIG. 3, with the collet being released from a collet profile formed in the inner surface of the seat, and with the torque anchor in its set position holding the seat. In this view, the expander tool has been activated to begin to expand the whipstock seat.

The torque anchor 50 is run into the wellbore on the working string 42 along with the expander tool 20 and the seat 10. The run-in position of the torque member 50 is shown in FIG. 3. In this position, the wheel housings 53 are maintained essentially within the torque anchor body 50. Once the seat 10 is lowered to the appropriate depth within the wellbore 44 and oriented, the torque anchor 50 is activated. Fluid pressure provided from the surface through the working tubular 42 acts against the wheel housings 53 to force the wheels 54*c* and 54*s* from the torque anchor body 50. Wheels 54*c* act against the inner surface of the casing 44, while wheels 54*s* act against the inner surface of the seat 10. This activated position is depicted in FIG. 6.

Figure 7:
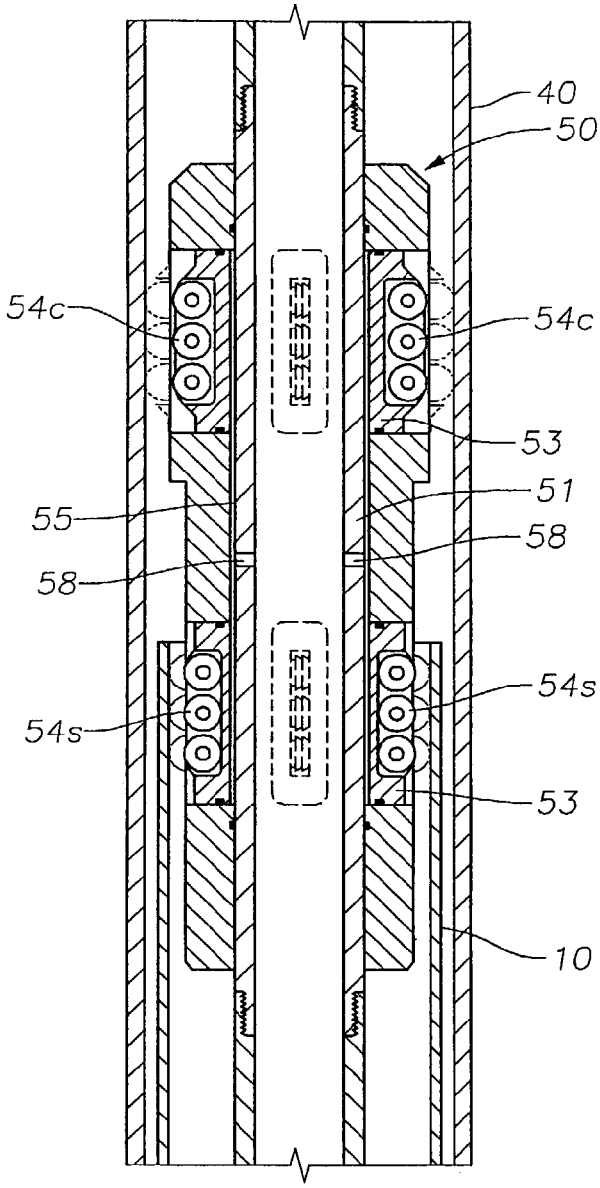
FIG. 7 is a cross-sectional view of a torque anchor in its retracted position. The extended position of the wheels is shown in phantom.

FIG. 7 presents a cut-away view of the torque anchor 50. Visible within the cut-away is a rotating sleeve 51 which resides longitudinally within the torque anchor 50. The sleeve 51 rotates independent of the torque anchor body 50. Rotation is imparted by the working tubular 42. In turn, the sleeve 51 provides the rotational force to rotate the expander tool 20. The extended position of the wheels 54*c* and 54*s* is shown in phantom.

An annular space 55 exists between the sleeve 51 and the wheel housings 53. Through-openings 58 reside within the sleeve 51 which allow fluid to enter the annular space 55 and act against the wheel housings 53. The wheel housings 53, in turn, extrude from the torque anchor body 50 and grip the casing 40 and seat 10, respectively, to prevent rotation during initial expansion of the seat 10. It will be appreciated that the initial vertical movement of the expander tool 20 will need to be upward. This is because the size of the torque anchor 50 will prevent the expander tool 20 from moving downward until after the upper portions of the seat 10 have been expanded. As the expander tool 20 is raised, the seat wheels 54*s* on the torque anchor 50 clear the top of the seat 10. By that time, however, the seat 10 is sufficiently expanded to prevent rotation with the expander tool 20. Once the upper portions of the seat 10 have been expanded, the expander tool 20 is lowered so that the lower portions of the seat 10 can be expanded.

After the whipstock seat 10 has been completely expanded into frictional contact with the inner wall of the casing 40, the expander tool 20 is deactivated. In this regard, fluid pressure supplied to the pistons 26 is reduced or released, allowing the pistons 26 to return to the recesses 27 within the central body part 28 of the tool 20. The expander tool 20 can then be withdrawn from the wellbore 44 by pulling the working tubular 42. The wellbore 44 is then ready to receive the whipstock 30.

Figure 8:
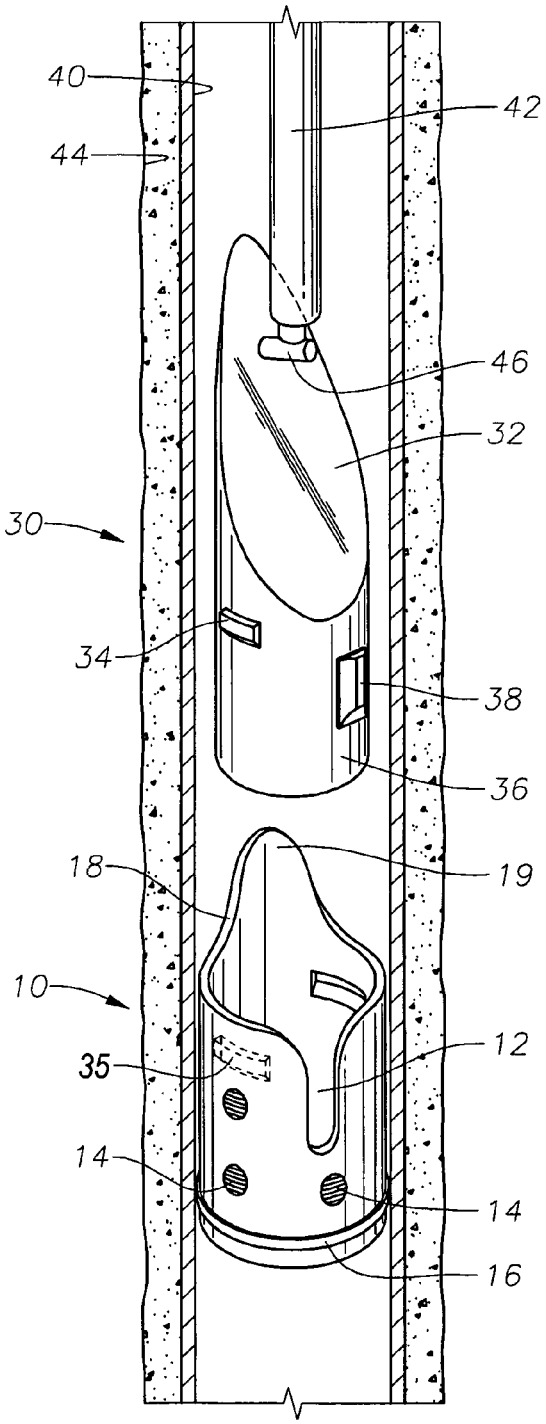
FIG. 8 is a perspective view of a whipstock being run into a parent wellbore, and being positioned for seating into a whipstock seat of the present invention. In this view, the whipstock seat has been expanded into contact with the casing of the parent wellbore.

After the seat 10 is expanded along its length, a whipstock 30 is run into the wellbore 44. FIG. 8 is a perspective view of a whipstock 30 being run into a parent wellbore 44, and being positioned for landing into an expanded whipstock seat 10 of the present invention. The whipstock 30 is run into the wellbore 44 on a working tubular 42. The tubular 42 again may be a jointed tubing or coiled tubing or other working string. In the preferred embodiment, a releasable connection is utilized between the tubular 42 and the whipstock 30, such as a shearable pin. A releasable connection is shown schematically at 46 in FIG. 8.

The whipstock 30 includes an orientation member 38. In one aspect, the orientation member 38 is located proximal to the bottom end 36 of the whipstock 30. The orientation member 38 defines a key which extends outward from the whipstock 30. The orientation member 38 is dimensioned to land on the top edge 18 of the seat 10 within the keyway 12 as the whipstock 20 is lowered into the wellbore 44. It is within the scope of this invention to provide an orientation member 38 for a whipstock 30 which is adjustable relative to the direction of the face 32 of the whipstock 30. In this manner, the seat 10 can be expanded into the casing 40 in any orientation, and the radial position of the orientation member 38 adjusted so that the face 32 of the whipstock 30 is properly oriented when the whipstock 30 is landed.

Figure 9:
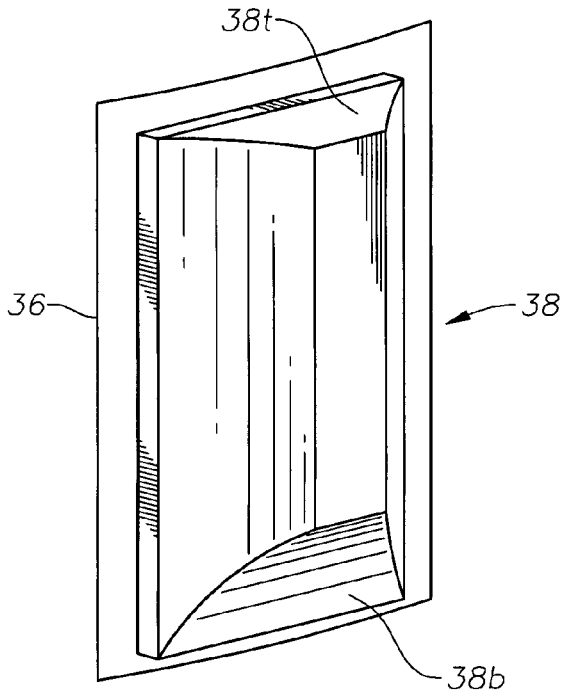
FIG. 9 is a perspective view of an orientation member as might be used in a whipstock, for landing in the whipstock seat of the present invention.

FIG. 9 is a perspective view of an orientation member 38 as may be used in the whipstock 30. In this embodiment, the orientation member 38 includes a flat upper surface 38*t* and a beveled bottom surface 38*b*. The beveled bottom surface 38*b* facilitates the landing of the whipstock 30 onto the seat 10. However, any configuration of the orientation member 38 will serve the purposes of the present inventions, so long as the orientation member 38 is dimensioned to land within the keyway 12 of the seat 10.

As the whipstock 30 is lowered into the wellbore 44, the whipstock 30 comes into contact with the positioned seat 10. The orientation member 38 meets the top edge 18 of the seat 10 at some point thereon. Because the top edge 18 of the seat 10 is sloped downward from a top end 19 and along opposite sides 13 to the keyway 12, the whipstock 30 is guided downward into the keyway 12. Thus, the orientation member 38 travels along the top edge 18 of the seat 10 until it lands in the keyway 12. Those of ordinary skill in the art will understand that the tubular 42 will rotate as it is lowered into the wellbore 44 to allow the orientation member 38 to land into the keyway 12, thereby automatically orienting the whipstock 30 in the proper direction for the drilling of a lateral wellbore (not shown).

An additional feature of the seat of the present invention is the use of an external seal member 16. The optional seal member 16 is depicted in the perspective view of FIG. 8. The seal member 16 is circumferentially attached to the seat 10 along its outer surface, thereby providing a fluid seal between the seat 10 and the casing 40 after the seat 10 has been expanded. The seal member 16 is preferably fabricated from an elastomeric material to facilitate the fluid seal with the casing 40.

Figure 10:
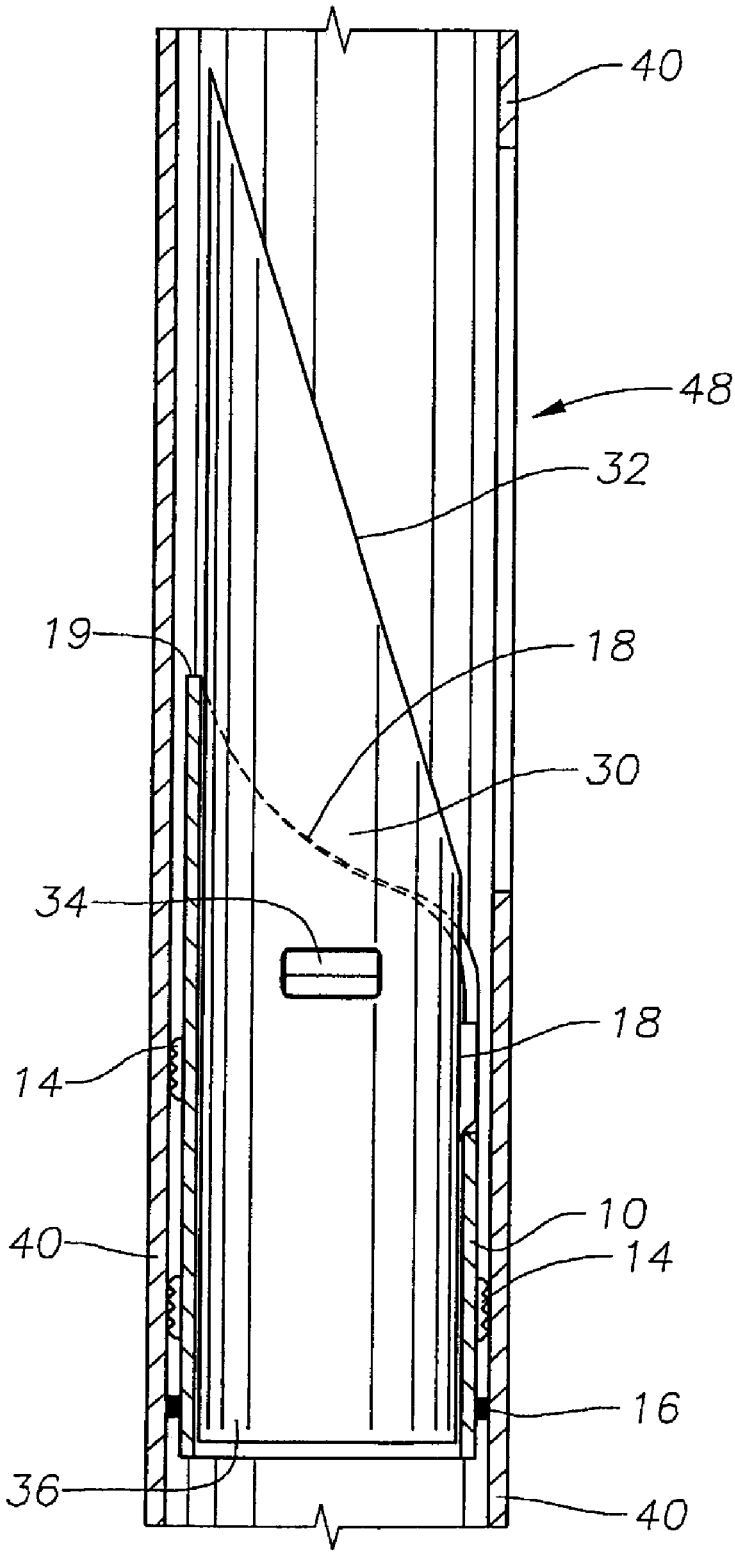
FIG. 10 is a schematic view of a whipstock landed into a whipstock seat of the present invention.

FIG. 10 is a schematic view of a whipstock 30 landed into a whipstock seat 10 of the present invention. The seat 10 is shown in cross-section. To further facilitate the landing of the whipstock 30 into the seat 10, and to make the landing more secure, a plurality of dogs 34 may optionally be added to the whipstock 30. Dogs 34 are seen in FIG. 10, as well as in the perspective view of FIG 8. Dogs 34 are configured to land in a profile 35 within the inner surface of the seat 10. The dogs 34 are biased to extend outward from the body 36 of the whipstock 30, but are capable of retracting to a first recessed position along the plane of the body 36 when the dogs 34 come into contact with the top edge 18 of the seat 10. In this manner, the dogs 34 will recess upon contact with top edge 18, but then pop into place within the correct profile 35 once the orientation member 38 seats fully into the keyway 12.

After the whipstock 30 is landed into the seat 10, the connection between the whipstock 30 and the tubular 42 is sheared. This can be accomplished preferably by asserting downward force on the tubular 42 after whipstock 30 has landed into the seat 10. The tubular 42 can then be pulled for subsequent sidetrack drilling operations. Alternatively, where a milling bit (not shown) is connected between the tubular 42 and the whipstock 30, milling operations can begin without necessity of pulling the tubular 42. Window 48 in casing 40 is depicted in FIG. 10, demonstrating a formed opening through which lateral drilling can take place.

As the foregoing demonstrates, the present invention provides a novel, expandable seat for landing a whipstock. A novel method for seating a whipstock into a wellbore for sidetrack drilling operations is also disclosed. In this respect, a seat 10 is run into a cased wellbore 44. The seat 10 in one aspect is lowered into the wellbore 44 at a desired depth, along with an expander tool 20. The expander tool 20 is activated so as to expand the seat 10 along its entire longitudinal length. The seat 10 is thereby frictionally set within the inner surface of the casing 40. The expander tool 20 is removed from the wellbore 44, and a whipstock 30 is then lowered therein. As the whipstock 30 is run into the hole 44, it comes into contact with the top edge 18 of the seat 10. The orientation member 38 of the whipstock 10 meets the top edge 18 of the seat 10, whereupon it travels downward along the top edge 18 until it lands securely in the keyway 12. The whipstock 30 is thus seated in proper orientation.

While the foregoing is directed to embodiments of the present invention, other and further embodiments of the invention may be devised without departing from the basic scope thereof, and the scope thereof is determined by the claims that follow.

What is claimed is:

1. An expandable seat for setting a tool in proper orientation within a cased wellbore, comprising:

an outer surface having a diameter which is less than the inner diameter of the cased wellbore;

an inner surface having a diameter dimensioned to receive at least a portion of the tool; and a locating surface for receiving an orientation surface of the tool after the seat is expanded and set within the cased wellbore, wherein the seat is circumferentially expanded along its entire length; and at least one releasable connection between the expandable seat and an expander tool such that the seat and the expander tool may be run into the cased wellbore together, wherein the releasable connection defines at least one collet which resides with a collet profile within the inner surface of the seat, the collet is moveable from a first extended position within the collet profile while the collet supports the seat to a second retracted position while the seat is being expanded.

2. An expandable seat for setting a tool in proper orientation within a cased wellbore, comprising:

an outer surface having a diameter which is less than the inner diameter of the cased wellbore;

an inner surface having a diameter dimensioned to receive at least a portion of the tool;

a locating surface for receiving an orientation surface of the tool after the seat is expanded and set within the cased wellbore, wherein the seat is circumferentially expanded along its entire length; and at least one releasable connection between the expandable seat and an expander tool such that the seat and the expander tool may be run into the cased wellbore together, wherein the releasable connection defines at least one collet which resides with a collet profile within the inner surface of the seat, the collet is mechanically released from the collet profile in the seat when the seat is expanded.

* * * * *